US006359533B1

(12) United States Patent
Merlock et al.

(10) Patent No.: US 6,359,533 B1
(45) Date of Patent: Mar. 19, 2002

(54) COMBLINE FILTER AND METHOD OF USE THEREOF

(75) Inventors: Alan J. Merlock, Waukegan; Julie A. Adam, West Dundee; Gregory A. Alms, Roselle, all of IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/520,293

(22) Filed: Mar. 7, 2000

(51) Int. Cl.[7] ..... H01P 1/20; H01P 3/06

(52) U.S. Cl. ..... 333/203; 333/202; 333/206; 333/207

(58) Field of Search ..... 333/202, 203, 333/206, 207

(56) References Cited

U.S. PATENT DOCUMENTS 3,408,599 A * 10/1968 Horton et al. ..... 333/203
3,539,953 A * 11/1970 Jones ..... 333/203
4,488,130 A * 12/1984 Young et al. ..... 333/203
5,151,670 A * 9/1992 Blair et al. ..... 333/126

* cited by examiner

*Primary Examiner*—Robert Pascal
*Assistant Examiner*—Patricia T. Nguyen
(74) *Attorney, Agent, or Firm*—Jeffrey K. Jacobs

(57) ABSTRACT

A radio frequency mechanical filter (10) of the resonant type employs a plurality of parallel spaced-apart resonators (40) disposed within a housing (16) defining a cavity. The resonators are supported at their first ends (46) to one wall (20) of the housing (16), with the remaining ends of the resonators being unsupported. A TEFLON support bracket (12) is disposed across the resonators (40) at points between the ends (44, 46) of the resonators. In one form, the support bracket (12) is movable along the length of the resonators to change the center frequency and bandwidth response of the filter.

18 Claims, 3 Drawing Sheets

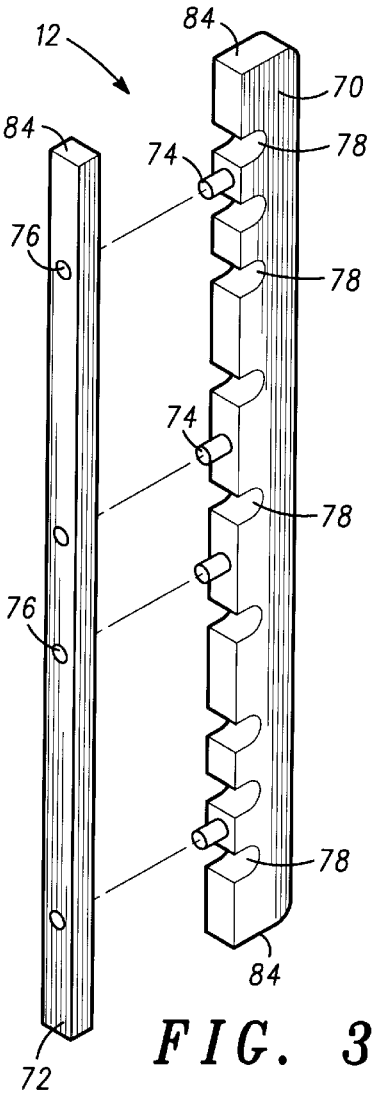
FIG. 3
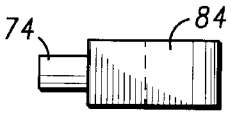
FIG. 5
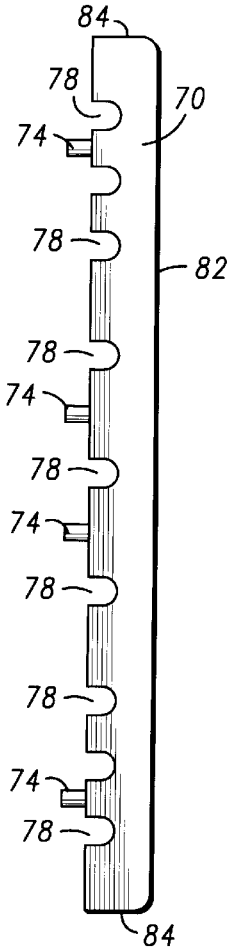
FIG. 4
FIG. 6
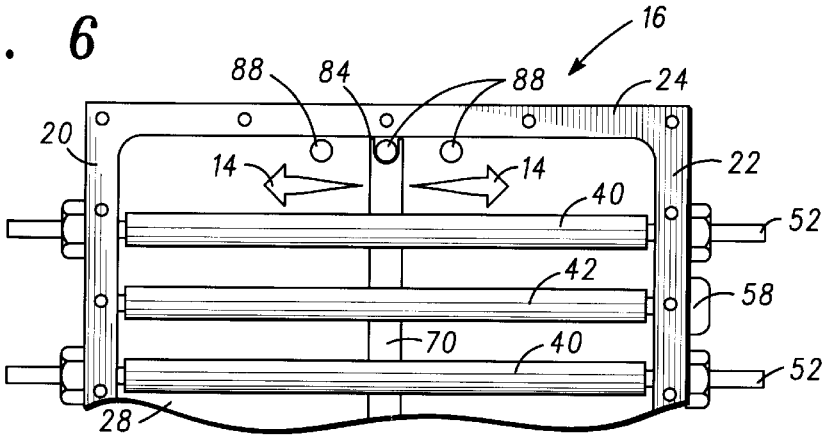

COMBLINE FILTER AND METHOD OF USE THEREOF

BACKGROUND OF THE INVENTION

1. Field of the Invention

The present invention pertains to combline filters and, in particular, to radio frequency band pass filters.

2. Description of the Related Art

Various filter designs have been proposed to allow certain frequencies to be transmitted to the output load while rejecting the remaining frequencies. Such filters designed for use in the frequency range of several hundred megahertz to one gigahertz include as an important example, combline strip line filters fixed to a design frequency. These types of filters are sometimes termed "mechanical" filters, a reference to their physical construction. Combline filters of this type, especially when designed for high Q, low insertion loss applications, require demanding high tolerance O-ring and bushing components and correspondingly intricate assembly techniques, requiring substantial labor investment.

It is not uncommon, due to the long lead time sometimes required for fabrication and delivery, that the design frequency characteristics of an earlier fabricated filter may no longer precisely match requirements needed at the time of installation. In order to alter the center frequency of the filter, for example, the filter must be returned to the manufacturer for rebuilding. Time delays can be reduced by maintaining an inventory at the manufacturer's site, although warehousing and storage costs incurred by the manufacturer are substantial and ultimately the purchaser incurs additional charges for the replacement service.

BRIEF DESCRIPTION OF THE DRAWINGS

FIG. 3 is an exploded perspective view of the support bracket showing the notched and cover support thereof;

FIG. 4 is a side elevational view of the notched support showing recesses formed therein;

FIG. 5 is an end elevational view of the notched support showing one of the studs for attaching to the cover support; and FIG. 6 is a fragmentary top plan view of a modification to the radio frequency combline filter of FIG. 1 having tuning adjustment studs for cooperating with the support bracket.

DETAILED DESCRIPTION OF THE PREFERRED EMBODIMENTS

The present invention finds advantages in applications where demanding combline filter performance is required, especially where filters are required to have a high Q and low insertion loss. The present invention provides advantages in this regard by employing relatively long resonators while eliminating losses associated with support bushings and O-rings located at the tuned end of the resonators. At the same time, the filter does not increase the microphonic risk associated with unwanted vibrations of the tuned ends of the resonators. Moreover, the present invention provides further advantages in applications where frequency adjustment is required at the installation site, as this can now be readily accomplished without requiring complex diagnostic equipment and procedures. Further, in certain instances, the present invention allows a shift in filter bandwidth, with a simple mechanical adjustment.

As will be seen herein, advantages of the present invention result from elimination of bushing supports and O-rings at the tuned ends of the resonators and the introduction of a continuous support spanning all of the resonators employed, located at mid-portions of the resonators, between their fixed ends and tuned ends.

Figure 1:
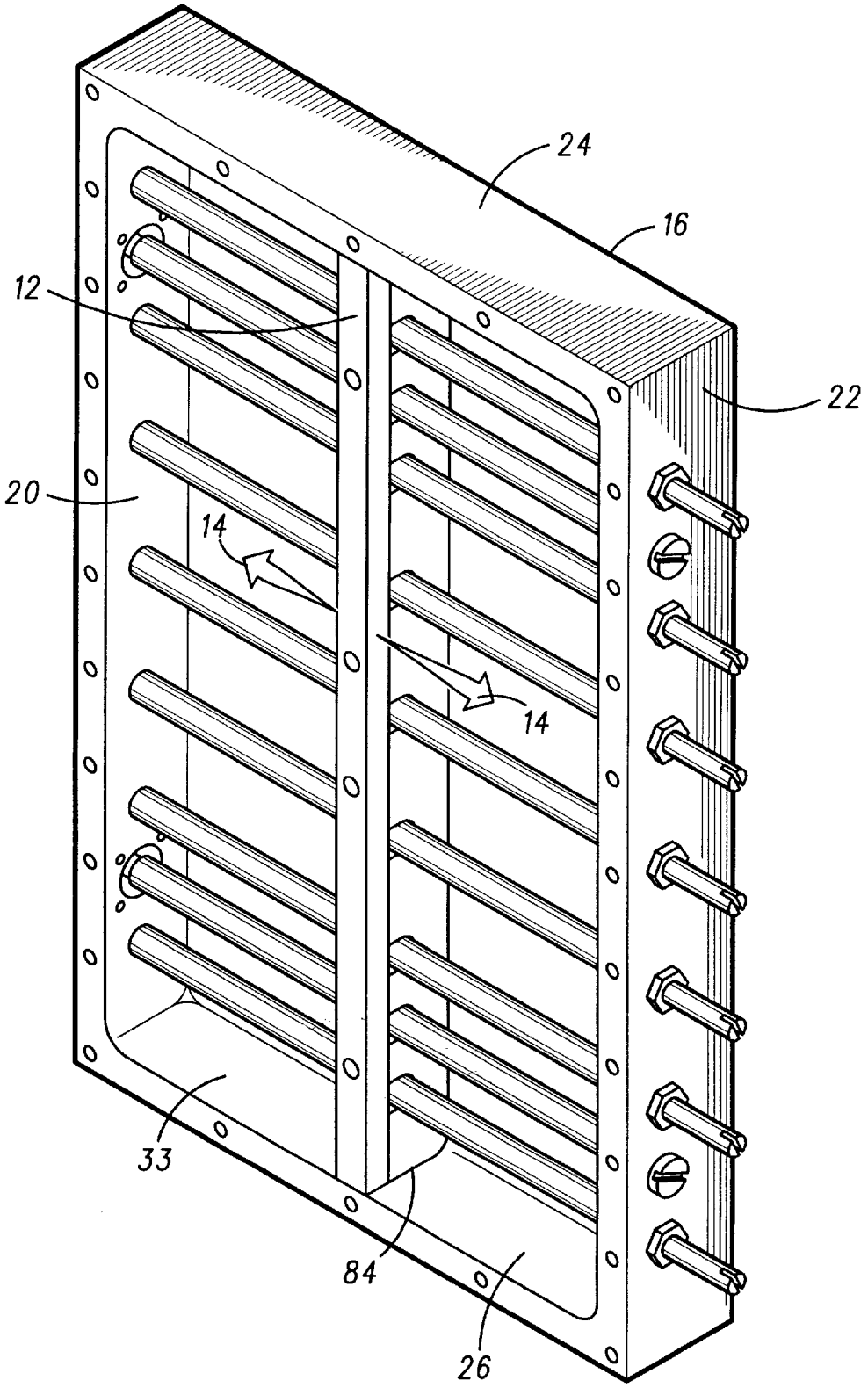
FIG. 1 is a perspective view of a radio frequency combline filter in accordance with the present invention showing the housing with a cover thereof removed for viewing the resonator and transform rods and support bracket therefor in the housing.
Figure 2:
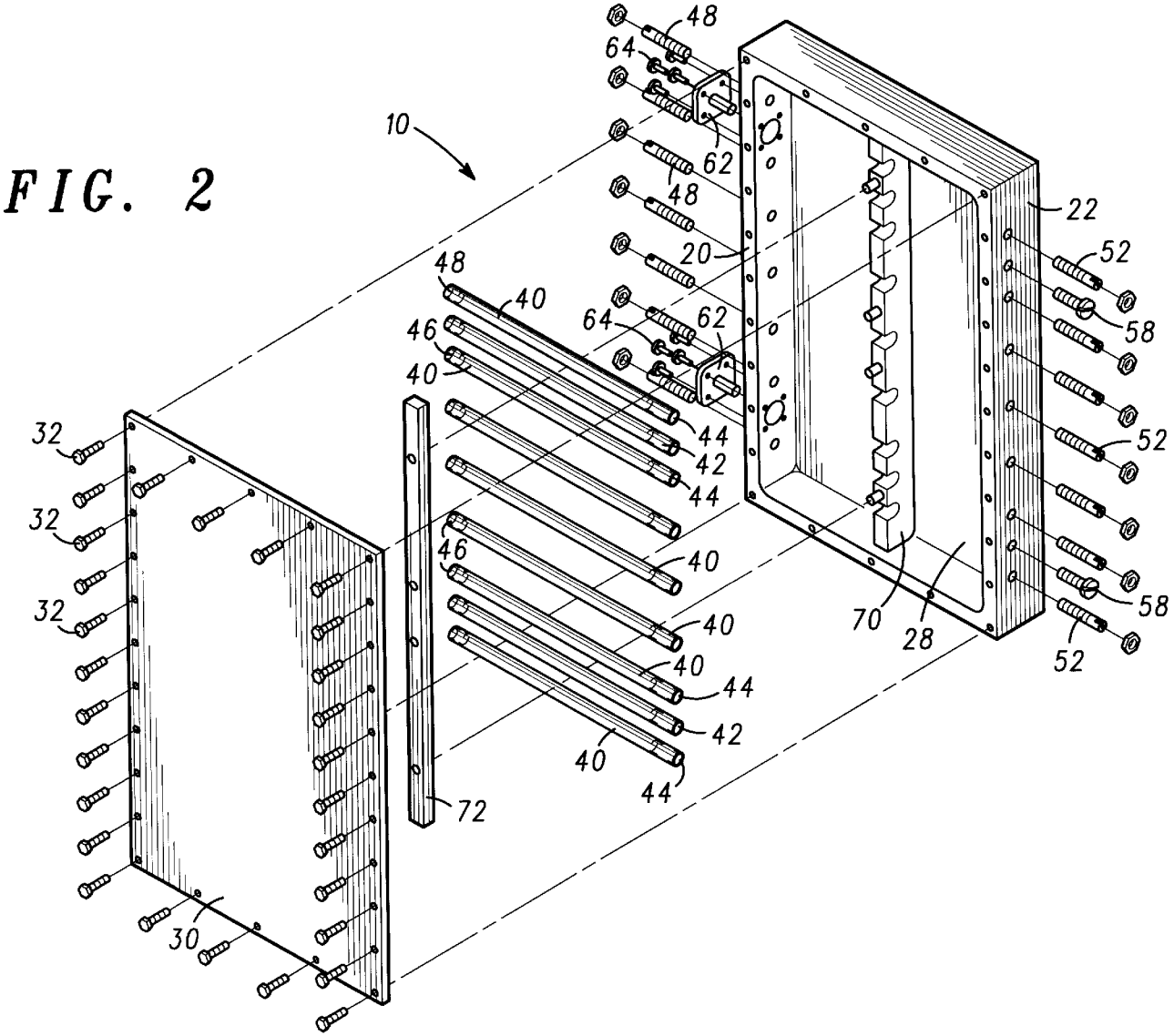
FIG. 2 is an exploded perspective view of the filter of FIG. 1.

Turning now to the drawings and initially to FIG. 2, an improved combline filter 10 with either fixed or adjustable frequency characteristics (i.e., center frequency and bandwidth) is shown. In the adjustable frequency embodiment, the frequency characteristics are adjusted by merely shifting a resonator support bracket 12 from side to side as indicated by arrows 14 in FIG. 1. In the preferred embodiments, filter 10 is employed as a pass band filter operating in the 400 MHZ range.

As can be seen in FIGS. 1 and 2, filter 10 includes a metal housing 16, preferably formed from a machined aluminum slab. Housing 16 can include first and second spaced-apart walls 20, 22 and a pair of opposed end walls 24, 26, and a back wall 28. As shown in FIG. 2, the housing includes a sheet metal cover 30 secured to the housing walls by a plurality of threaded fasteners 32.

A plurality of parallel spaced-apart resonators are disposed within a substantially hollow cavity 33 of the housing 16. Included are seven conventional resonator rods 40 and two conventional transform rods 42. Preferably, the resonator rods 40 are of solid cylindrical construction, although hollow resonator rods or resonator rods of other construction can be employed, if desired. The preferred resonator rods 40, although solid, are provided, as indicated in FIG. 2, with hollow ends 44 for tuning the resonating frequency of the rods 40 and accordingly ends 44 will be referred to herein as the tuned ends of the resonator rods 40. The opposite ends 46 of the resonator rods 40 (herein referred to as support ends) are secured to wall 20 by fasteners 48. Tuning elements 52 pass through wall 22 and are received in the hollow tuned ends 44 so as to provide conventional tuning for the resonator rods 40. The transform rods 42 are mounted at their first ends to wall 22 by fasteners 58. Opposite ends of the transform rods pass through wall 20 and are supported by transform mounts 62 shown in FIG. 2, secured to wall 20 by fasteners 64.

In order to meet high Q, low insertion loss design requirements, the resonator rods 40 and transform rods 42 are relatively long and in the preferred and illustrated embodiment are made to span a distance of approximately six inches. As those skilled in the art will appreciate, if the resonator rods 40 are left unsupported, there would be a significant microphonic risk in the performance and reliability of the filter, and which could ultimately lead to mechanical failure due to vibration of the rods. Heretofore, these drawbacks have been addressed by either shortening the length of the resonator rods or supporting the tuned end of the resonator rods, e.g., with bushings made of dielectric material, such as TEFLON. Certain demanding applications require filters of increased performance which cannot be obtained by either of these conventional methods for providing the necessary support for the longer resonator rods. While the full length of the resonator rods can be physically supported by using TEFLON bushings and associated O-rings located at the tuned ends of the resonators, such arrangements inherently degrade the Q of the filter and have been observed to incur signal losses which are objectionable in more demanding applications. In other words, because the tuned ends of the rods are press fit in the bushings, stresses are introduced which over time can degrade the signal in an inexact and unpredictable manner. Further, the tight tolerances for providing the press fit between the bushings, O-rings and rods generate undesirable manufacturing costs and difficulties.

The present invention avoids the above-discussed O-rings and bushings used for support at the tuned end of the resonator rods. The filter 10 herein uses the single support bracket 12 of dielectric, preferably TEFLON material located generally in the mid-portions of the resonator rods, spaced from the opposite rod ends 44, 46, as illustrated. As can be seen for example in FIG. 1, the TEFLON support bracket 12 generally spans the length of the housing 16. Referring to FIGS. 1–3, the TEFLON support bracket 12 is preferably formed with a pair of mating support members, including a notched support 70 and a covering support 72. As best seen in FIG. 3, studs 74 projecting from notched support 70 are received in apertures 76 formed in covering support 72. Preferably, a friction fit between studs 74 and apertures 76 is provided to securely maintain the support members 70, 72 in a joined position, once mated. If desired, compressive force applied to covering support 72 by sheet metal cover 30 may be relied upon to maintain support members 70, 72 in a joined position, provided the covering support is appropriately dimensioned for this purpose.

Notched support 70 has a plurality of arcuate recesses 78 for receiving the resonator rods 40 in the manner indicated, for example, in FIG. 1. The filter 10 according to the present invention is fabricated at a substantial cost savings since labor intensive fitting of O-rings and bushings at the tuned ends of the resonator rods is no longer required. Rather, the notched support 70 is inserted within the housing cavity in the manner indicated for example in FIG. 2, with its bottom surface 82 engaging wall 28 and with its ends 84 engaging end walls 24, 26. A variety of conventional means may be employed to secure the notched support in a fixed position, such as adhesives or dielectric fasteners, for example. However, it is most preferred that notched support 70 be mounted for lateral movement in the direction of arrows 14 shown in FIG. 1 in order to provide ready adjustment of the filter's frequency characteristics. To this end, the relative sizing of the openings provided by the attached supports 70 and 72 and the diameter of the rods 40 and transforms 42 cooperate to provide an adjustable mount for the bracket 12 relative to the rods 40 and transforms 42 to allow the bracket 12 to slide laterally thereon. The preferred dielectric TEFLON material of the bracket 12 assists in implementing the adjustable mount as it generally has a low coefficient of friction associated therewith.

The introduction of dielectric material of the support bracket in the mid-portions of the resonator rods alters both the coupling co-efficients and the capacitance between the resonators and between the resonators and the ground plane. As will be explained herein, these parameters change with respect to the mounting location of the support bracket 12 within the filter housing in such a way as to shift the tuned frequency of the filter. This shift in frequency occurs fairly, such that the filter remains within specifications if shifted one band lower (such as, between five and six MHZ) associated with movement of the support bracket 12 by a predetermined distance which can be less than a few inches, typically on the order of one inch, in either direction from a support bracket center position.

If desired, dielectric studs can project from back wall 28 at spaced intervals in the direction 14 so as to be received in notched stud 70, in the manner similar to that shown in FIG. 3, for example. In another form, spaced dielectric studs 88 may extend from wall 28 so as to be received in notches formed in the end 84 of support 70. These types of arrangements allow the notched support 70 to be moved a fixed, predetermined distance along the length of resonator rods 40 and the transform rods 42, to thereby carry out a precisely known or predetermined tuning adjustment of filter 10. Variations in the filter design are possible. For example, with support 12 projecting beyond end walls 24, 26, motor driven lead screw arrangements or lever arm arrangements (not shown) can be provided to move the support bracket within the housing cavity without requiring disassembly of the filter.

After the notched support 70 is installed within the housing cavity 33, the resonator rods 40 and transform rods 42 are installed, and are allowed to rest within the recesses 78. With the resonator and transform rods installed, the covering support 72 is joined to notched support 70. In this manner, notched support 70 aids commercial manufacture and assembly by providing alignment of the resonator rods 40 within the housing cavity 33, and so as to stabilize the tuned ends 44 of the resonator rods 40 while the tuning elements 52 are being fitted. Notched support 70 also provides improved accuracy in the positioning and parallelism of the resonator rods 40 and transform rods 42. The covering support 72 also holds the resonator and transform rods 42 secured during shipping, providing a cushioning at the mid-portions of the resonator and transform rods, preventing their mis-alignment while reducing the stresses imparted to the tuned ends of the resonator rods.

In a conventional manner, the slabline housing 16, made of an assembly of metal components, provides grounding for the electrically active elements, e.g., the resonator and transform rods. As mentioned, by shifting the support 12 along the length of the resonators 40, both resonator-to-resonator capacitance and resonator-to-ground capacitance are uniformly increased or decreased for each resonator, thus changing the frequency characteristics of the filter in an advantageous manner.

As mentioned, filter 10 employs input transform rods 42 in the combline filter construction. As a result, as the filter 10 is tuned up in frequency, the bandwidth of the filter decreased, and as the filter 10 is tuned down in frequency, the bandwidth of the filter increases. In the preferred embodiment, it is possible, with movement of support 12, to shift the bandwidth of filter 10 by a commercially significant amount. Previously, a replacement housing would have to be constructed, in order to accommodate different spacing between resonator rods and transform rods. For a commercial manufacturer of filters, a substantial cost savings can be enjoyed since a number of different filters can now be replaced with a single adjustable filter according to principles of the present invention, thereby reducing parts inventory and associated costs.

By providing the filter with an adequate tuning range (e.g., in both the tuning screws and aperture coupling screws - not shown) the bandwidth of the filter 10 can be adjusted while maintaining filter frequency constant. As mentioned, the filter 10 operates in the 400 MHZ range and the resonator rods span a distance of approximately six inches. In the preferred embodiment, by tuning elements 52, a filter originally configured with 0.5 dB bandwidth of six MHZ was adjusted to operate as a filter with a 0.5 dB bandwidth of approximately 4.5 MHZ, with a shifting of support 12 approximately one inch toward the support ends 46 of resonator rods 40. As mentioned, according to observed phenomenon with combline filters having input transform rods, this reduction in bandwidth is associated with an increase in filter frequency, and accordingly the filter frequency was reduced to its original value by adjustment of tuning elements 52. A similar, but opposite shift in frequency characteristics was also observed when support 12 is shifted a like amount (approximately one inch) toward the tuned ends 44 of resonator rods 40.

The emphasis above was on changing the bandwidth of the combline filter. It is also important to emphasize that the tuned frequency of the combline filter 10 may also be readily changed. With the tuning arrangement of the present invention, movement of the support 12 along the length of the resonators by a distance of one inch, the filter frequency is adjusted up or down one channel, that is, approximately five to six MHZ. That is, when the support 12 is moved approximately one inch closer to the tuned ends of the resonators 40, the filter frequency is moved up approximately five MHZ. If the support is moved toward the support end 46 of the resonator rods by a distance of approximately one inch, the filter frequency is shifted down approximately five MHZ.

It is important to note that the changes in frequency characteristics of the combline filter 10 are path independent and are found to be reliably restored upon return of the support bracket 12 to its original position within the housing cavity 33. Further, it is possible to alter frequency characteristics of the combline filter 10 under field operating conditions without requiring elaborate diagnostic and test equipment, especially if a frequency change is desired.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A combline filter, comprising:

a housing having a hollow interior cavity;

a plurality of parallel, spaced-apart resonators disposed within the cavity;

first ends of the resonators supported by the housing;

second tuned ends of the resonators opposite the first ends for being tuned to adjust resonating frequencies of the resonators; and a support bracket of dielectric material disposed within the cavity and extending transverse to the plurality of resonators to cooperate with the housing for supporting the resonators, wherein said support bracket receives said resonators so as to encircle portions of the resonators wherein said support bracket is comprised of first and second generally co-extensive support members removably joined to one another.

2. The filter of claim 1 wherein the support bracket is located at mid-portions of the resonators.

3. The filter of claim 1 wherein said housing is machined from a metal slab.

4. The filter of claim 1 further comprising one or more input transform rods disposed within said cavity.

5. The filter of claim 4 wherein seven resonators and two input transform rods are disposed within said cavity and supported by said support bracket.

6. The filter of claim 1 wherein said support bracket is comprised of first and second generally co-extensive mating parts with the first part having a plurality of recesses for receiving said resonators and a second part being for enclosing said recesses so as to hold the resonators within said support bracket.

7. The filter of claim 1 wherein the filter is a radio frequency combline filter.

8. The filter of claim 1 wherein said resonators are approximately six inches in length and the filter operates at least one frequency which is approximately 400 MHZ.

9. A filter, comprising:

a housing having first and second spaced apart walls and defining a hollow interior cavity bounded by the walls;

a plurality of parallel, spaced-apart resonators disposed within the cavity and having first ends supported from one wall of the cavity and second tuned ends located adjacent the second wall of the housing;

a support bracket of dielectric material disposed within the cavity and extending across the plurality of resonators; and an adjustable mount between the resonators and the support bracket for allowing the support bracket to move along the length of the resonators for varying the frequency characteristics of the filter.

10. The filter of claim 9 further comprising mechanical stops for orienting the support bracket at different positions within the cavity.

11. The filter of claim 9 wherein the filter has a predetermined center frequency and bandwidth corresponding to an initial position of the support bracket, with the change in position of the support bracket within the cavity changing the center frequency and bandwidth of the filter.

12. The filter of claim 9 wherein said support bracket spans a predetermined dimension of the cavity generally perpendicular to the resonators.

13. The filter of claim 12 wherein said support bracket is movable in directions along the length of the resonators while maintaining the support bracket generally perpendicular to the respective resonators such that displacements of the support bracket with respect to the resonators is the same for each resonator.

14. The filter of claim 9 wherein further comprising input transform rods disposed within the cavity.

15. A method of adjusting the frequency response of a combline filter having a housing with a substantially hollow interior cavity, the method comprising:

disposing a plurality resonators within the cavity so as to be spaced-apart and parallel to one another;

supporting first ends of the resonators with the housing;

maintaining second ends of the resonators unsupported by the housing;

providing a support bracket of dielectric material;

disposing the support bracket within the cavity so as to extend across the plurality of resonators at points between ends of the resonators; and moving the support bracket along the length of the resonators to adjust the center frequency and bandwidth of the filter.

16. The method of claim 15 wherein said support bracket is comprised of first and second generally co-extensive support members, the method further comprising the step of joining the first and second support members so as to encircle respective portions of the resonators.

17. A filter, comprising:

a housing including a hollow interior cavity;

at least one resonator rod disposed within the cavity;

at least one transformer rod disposed within the cavity; and a bracket of dielectric material disposed within the cavity and engaging mid-portions of the at least one resonator rod and the at least one transformer rod, wherein the bracket includes an adjustable mount to cooperate with the rods for movement therealong.

18. The filter of claim 17, wherein the bracket is movable to one or more predetermined positions each defining a respective RF channel.

* * * * *